US010861633B2

(12) United States Patent
Kim et al.

(10) Patent No.: US 10,861,633 B2
(45) Date of Patent: Dec. 8, 2020

(54) INDUCTOR

(71) Applicant: SAMSUNG ELECTRO-MECHANICS CO., LTD., Suwon-si, Gyeonggi-do (KR)

(72) Inventors: Jae Hun Kim, Suwon-si (KR); Byeong Cheol Moon, Suwon-si (KR); Kang Wook Bong, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 225 days.

(21) Appl. No.: 16/117,385

(22) Filed: Aug. 30, 2018

(65) Prior Publication Data

US 2019/0259522 A1 Aug. 22, 2019

(30) Foreign Application Priority Data

Feb. 22, 2018 (KR) ..... 10-2018-0021048

(51) Int. Cl.
*H01F 27/24* (2006.01)
*H01F 27/28* (2006.01)
(Continued)

(52) U.S. Cl.
CPC ..... *H01F 27/24* (2013.01); *H01F 17/0013* (2013.01); *H01F 17/04* (2013.01);
(Continued)

(58) Field of Classification Search
CPC ..... H01F 27/24; H01F 17/04; H01F 27/292; H01F 17/0013; H01F 27/2804;
(Continued)

(56) References Cited

U.S. PATENT DOCUMENTS 9,035,423 B1 5/2015 Tsukahara et al.
9,976,224 B2 5/2018 Jeong et al.
(Continued)

FOREIGN PATENT DOCUMENTS

CN 1288240 A 3/2001
CN 103377811 A 10/2013
(Continued)

OTHER PUBLICATIONS

Japanese Office Action dated Dec. 11, 2018 issued in Japanese Patent Application No. 2018-160477 (with English translation).
(Continued)

*Primary Examiner* — Tuyen T Nguyen
(74) *Attorney, Agent, or Firm* — Morgan, Lewis & Bockius LLP

(57) ABSTRACT

An inductor comprises a body and external electrodes arranged on an external surface of the body. The body includes a support member, a coil portion supported by the support member, and a sealing portion sealing the support member and the coil portion. The coil portion includes a plurality of coil patterns. A maximum thickness of each coil pattern in the plurality of coil patterns increases toward an outer portion of the body, and a line width of a lower surface in the coil patterns is wider than a line width of an upper surface.

24 Claims, 4 Drawing Sheets

(51) Int. Cl.

| | |
|---|---|
| ***H01F 27/06*** | (2006.01) |
| ***H01F 27/29*** | (2006.01) |
| ***H01F 17/04*** | (2006.01) |
| ***H01F 17/00*** | (2006.01) |

(52) U.S. Cl.
CPC ..... *H01F 27/06* (2013.01); *H01F 27/2804* (2013.01); *H01F 27/29* (2013.01); *H01F 27/292* (2013.01); *H01F 2027/2809* (2013.01)

(58) Field of Classification Search
CPC .. H01F 27/06; H01F 27/29; H01F 2027/2809; H01F 17/00; H01F 27/327
See application file for complete search history.

(56) References Cited

U.S. PATENT DOCUMENTS

| | | | | |
|---|---|---|---|---|
| 2006/0001520 | A1* | 1/2006 | Kaji | H01F 17/0006 336/223 |
| 2008/0174398 | A1* | 7/2008 | Hsu | H01F 17/0006 336/200 |
| 2008/0303622 | A1* | 12/2008 | Park | H01F 17/0013 336/200 |
| 2009/0322458 | A1 | 12/2009 | Lee et al. | |
| 2013/0300529 | A1 | 11/2013 | Chang et al. | |
| 2015/0048920 | A1 | 2/2015 | Lee et al. | |
| 2015/0170823 | A1 | 6/2015 | Jeong et al. | |
| 2016/0071643 | A1 | 3/2016 | Heo et al. | |
| 2016/0293322 | A1 | 10/2016 | Yosui | |
| 2016/0351320 | A1 | 12/2016 | Jeong | |
| 2017/0330674 | A1 | 11/2017 | Lee et al. | |

FOREIGN PATENT DOCUMENTS

| | | | |
|---|---|---|---|
| CN | 104733154 | A | 6/2015 |
| CN | 104810132 | A | 7/2015 |
| CN | 206022030 | U | 3/2017 |
| CN | 107369536 | A | 11/2017 |
| EP | 1 085 538 | A1 | 3/2001 |
| JP | 08-097038 | A | 4/1996 |
| JP | 10-241983 | A | 9/1998 |
| JP | 2010-016337 | A | 1/2010 |
| JP | 2014-27251 | A | 2/2014 |
| JP | 2015-037179 | A | 2/2015 |
| JP | 2016-529732 | A | 9/2016 |
| JP | 2016-225463 | A | 12/2016 |
| JP | 2017-017140 | A | 1/2017 |
| KR | 10-1999-0066108 | A | 8/1999 |
| KR | 10-1525703 | B1 | 6/2015 |
| KR | 10-2016-0139967 | A | 12/2016 |
| TW | 201001457 | A | 1/2010 |
| WO | 2015/030976 | A1 | 3/2015 |
| WO | 2018/159455 | A1 | 7/2018 |

OTHER PUBLICATIONS

Office Action issued in corresponding Korean Application No. 10-2018-0021048, dated Apr. 30, 2019.

Office Action issued in corresponding Chinese Patent Application No. 201910133019.6 dated Oct. 15, 2020, with English translation.

* cited by examiner

INDUCTOR

CROSS-REFERENCE TO RELATED APPLICATION

This application claims benefit of priority to Korean Patent Application No. 10-2018-0021048 filed on Feb. 22, 2018 in the Korean Intellectual Property Office, the disclosure of which is incorporated herein by reference in its entirety.

BACKGROUND

1. Field

The present disclosure relates to an inductor and, more particularly, to a thin-film type power inductor, which is advantageous due to having a small size and high capacitance.

2. Description of Related Art

In accordance with the development of information technology (IT), the miniaturization and thinning of devices have accelerated and, at the same time, market demand for small, thin devices has increased.

Patent Document 1 discloses an attempt to provide an inductor suitable for meeting the demand of this technical trend. The inductor includes a uniform coil with a large aspect ratio. The inductor includes a substrate with a via hole, and a coil on both sides of the substrate and electrically connected through the via hole of the substrate.

In this inductor design, the area of the core region inside the coil is relatively narrow. Since magnetic flux concentrates mainly in the core region inside the coil, the flow of the magnetic flux must be optimized by improving the construction technology for the concentrated region of the magnetic flux.

(Patent Document 1) Korean Patent Laid-Open Publication No. 10-1999-0066108

SUMMARY

An aspect of the present disclosure is to provide an inductor having reduced magnetic resistance by optimizing the flow of magnetic flux.

According to an aspect of the present disclosure, an inductor comprises a body and first and second external electrodes arranged on an external surface of the body. The body comprises a support member including a through-hole and a via hole, a coil portion including first and second coils on opposing surfaces of the support member, respectively, and a sealing portion including magnetic materials sealing the support member and the coil portion. The first and second external electrodes are arranged on an external surface of the body and are connected to the first and second coils, respectively. The coil portion includes a plurality of coil patterns, and a maximum thickness of each coil pattern of the plurality of coil patterns increases toward an outer portion of the body. Each of the plurality of coil patterns includes a lower surface abutting the support member and an upper surface opposing the lower surface. The maximum thickness of the coil pattern is determined by its lower surface. A line width of the lower surface is wider than that of the upper surface.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
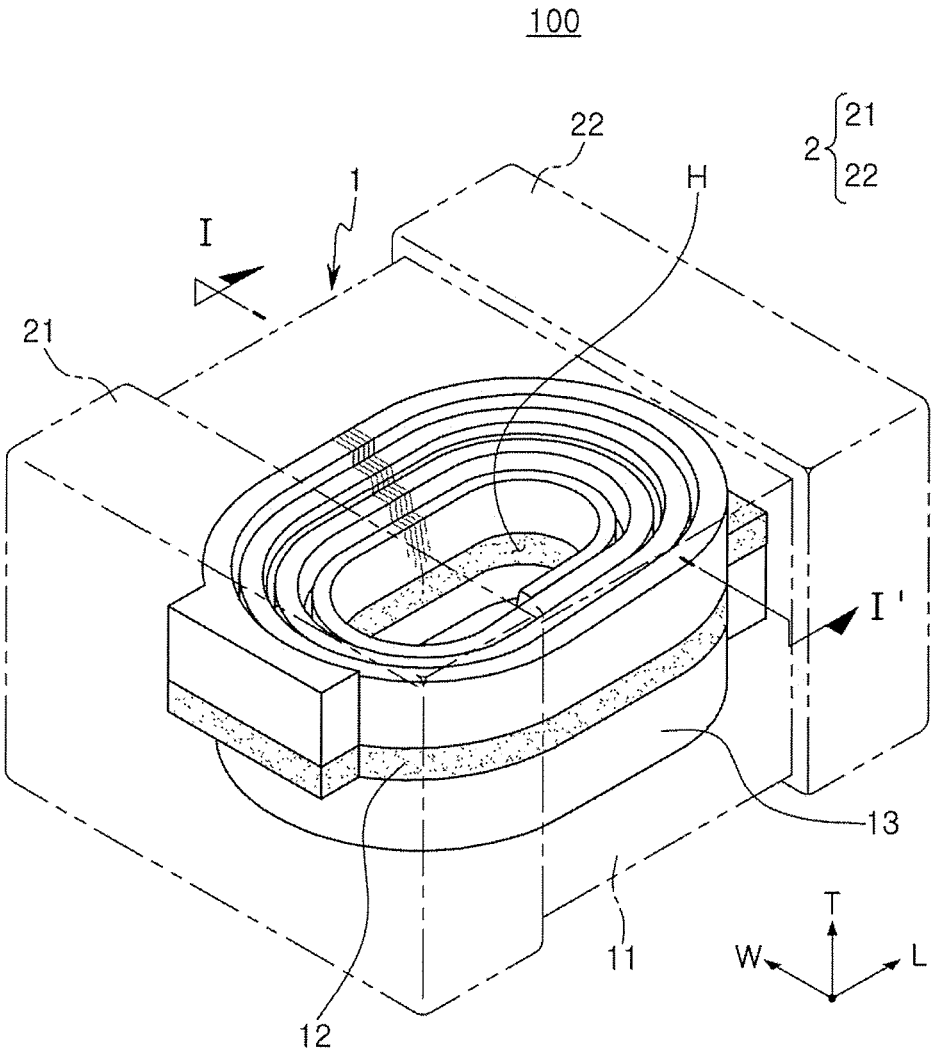
FIG. 1 is a schematic perspective view of an inductor according to a first embodiment of in the present disclosure.

Hereinafter, the present disclosure will be described with reference to specific embodiments and the accompanying drawings. However, the embodiments of the present disclosure may be modified to have various other forms, and the scope of the present disclosure is not limited to the embodiments described below. The embodiments of the present disclosure are provided to more fully describe the disclosure to those skilled in the art. The shapes and sizes of the elements in the drawings may be exaggerated for clarity, and the elements denoted by the same reference numerals in the drawings are the same elements.

In order to clearly illustrate the present disclosure in the drawings, portions not related to the illustration may be omitted. Thicknesses may be enlarged for the purpose of clearly illustrating the layers and regions. The same reference numerals are used to explain the same components having the same or similar functions.

Hereinafter, an exemplary inductor according to an example of the present disclosure will be described, but the present disclosure is not necessarily limited thereto.

First Embodiment

Figure 2:
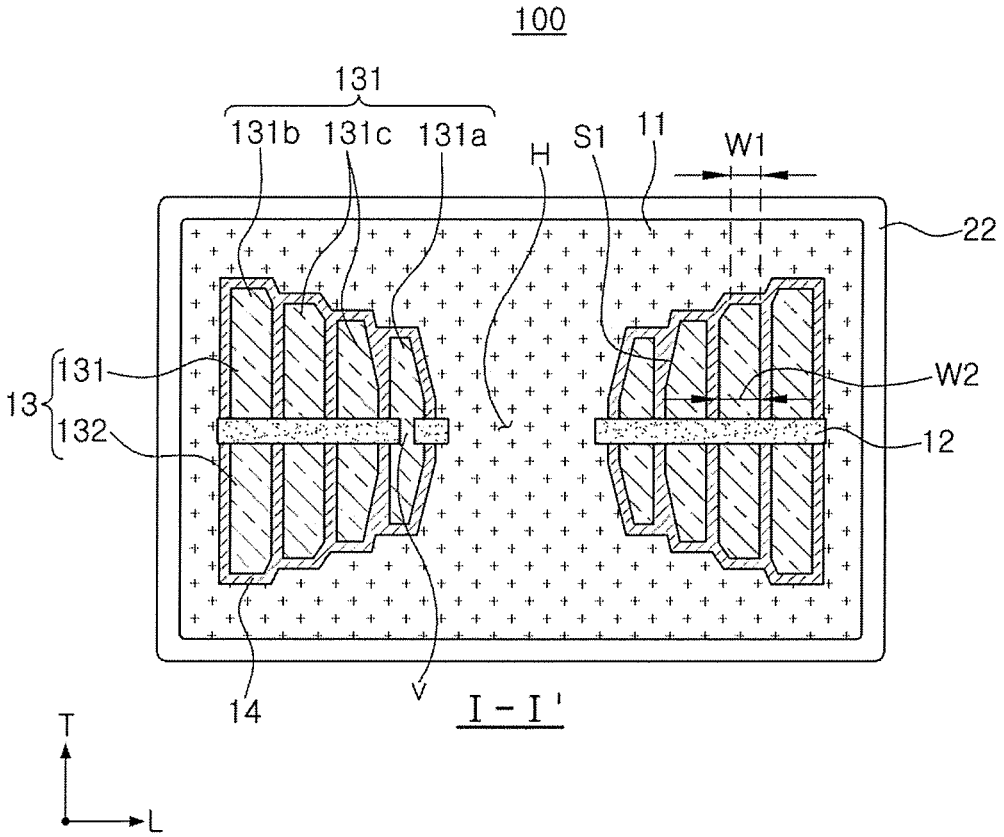
FIG. 2 is a cross-sectional view taken along line I-I' in FIG. 1.

FIG. 1 is a schematic perspective view of an inductor 100 according to a first embodiment of the present disclosure. FIG. 2 is a cross-sectional view taken along line I-I' of FIG. 1.

Referring to FIGS. 1 and 2, an inductor 100 may include a body 1, and external electrodes 2 arranged on an external surface of the body.

The external electrodes may include first and second external electrodes 21 and 22, spaced apart from each other and configured to function having different polarities. The external electrodes may be formed to have a "C" shape as illustrated, but that is merely an example. An "L" shape or a structure in which the first and second external electrodes are arranged on only one surface of the body may be appropriately selected by those skilled in the art. The external electrodes may include a conductive material, and may be formed of a plurality of layers, such as a Cu pre-plated layer, or the like, to improve a contact between a coil portion and the external electrodes.

The body 1 may substantially form an exterior of the inductor. The external surface of the body may include upper and lower surfaces opposing each other in a thickness (T) direction, first and second end surfaces opposing each other in a length (L) direction, and first and second side surfaces opposing each other in a width (W) direction. The body may have substantially a hexahedral shape.

The body 1 may include a sealing portion 11 including magnetic materials. The magnetic materials included in the sealing portion are not particularly limited, as long as they have magnetic properties. The sealing portion may be, for example, ferrite or a structure in which metal magnetic particles are dispersed within a resin. The metal magnetic particles may contain, for example, one or more selected from the group consisting of iron (Fe), silicon (Si), chromium (Cr), aluminum (Al), and nickel (Ni).

A support member 12 and a coil portion 13 may both be sealed by the sealing portion 11.

The support member 12 may be provided to assist the formation of, and properly support, the coil portion. The support member may include appropriate materials having insulating properties. There is no limitation on a shape of the support member, but in an inductor having a miniaturized size it is preferable that the support member has a thin plate shape to form a coil portion having a high aspect ratio. A thermosetting resin such as an epoxy resin, a thermoplastic resin such as polyimide, or a resin in which a reinforcing material such as a glass fiber or an inorganic filler is impregnated, for example, an Ajinomoto build-up film (ABF), FR-4, a bismaleimide triazine (BT) resin, a photo-imagable dielectric (PID) resin, or the like may be used in the support member.

A through-hole may be formed at a central portion of the support member 12. The through-hole may be filled with magnetic material to increase the permeability of the inductor. The support member 12 may further include a via hole spaced apart from the through-hole. The via hole may function as a passage for electrically connecting the first and second coils formed on opposing surfaces of the support member, respectively. The via hole may thus be filled with a conductive material. The via hole may be formed in plural to prevent an opening phenomenon. The conductive material filling the via hole is not particularly limited, as long as it is formed of a material having good conductivity. Meanwhile, considering the adhesion with the first and second coils, the conductive material filling the via hole is preferably the same as the conductive material of the first and second coils.

The coil portion 13 supported by the support member may include a first coil 131 on one surface of the support member, and a second coil 132 on an opposing surface of the support member. The first and second coils may be spirally formed as a whole, but are not limited to this shape.

The first coil 131 may be configured to be substantially symmetrical with respect to the second coil 132 on the basis of the support member. There may be a difference in that a lead-out portion of the first coil and a lead-out portion of the second coil are led out in different directions.

The coil portion, including the first and second coils, may include a plurality of coil patterns. For convenience of description, the plurality of coil patterns will be described with reference to the first coil, and the same contents may be applied to the second coil as well.

The plurality of coil patterns may include an innermost coil pattern 131*a* nearest to the through-hole, an outermost coil pattern 131*b* nearest to the external surface of the body, and a plurality of central coil patterns 131*c* arranged between the innermost coil pattern and the outermost coil pattern.

Referring to the cross-sectional view of the inductor illustrated in FIG. 2, each cross-section of the plurality of coil patterns 131*a*, 131*b* and 131*c* may include an upper surface, a lower surface, an inner side surface, and an external surface. The inner and external surfaces may connect the upper surface with the lower surface. The inner surface is the surface that faces toward the through hole, while the external surface is the surface that faces away from the through hole. The lower surface is the surface abutting the support member. The upper surface is the surface opposing the lower surface and is the surface that determines the maximum thickness of the coil patterns.

The maximum thickness of each coil pattern in the plurality of coil patterns may increase toward an outer portion of the body.

Generally, the flow of magnetic flux generated from the coil may cause a magnetic flux neck around the through-hole, that is, at a periphery of the central portion of the core in the coil. This is a problem caused by concentration of flow of the magnetic flux. As the size and thickness of the inductor is decreased, the problem of magnetic flux neck being generated at the periphery of the core becomes worse.

In the inductor of the present disclosure, since the thicknesses of the coil patterns increases toward the outer portion of the body, the thickness of the coil pattern at the periphery of the central portion of the core in the coil is relatively smaller. As a result, the effective cross-sectional area for the flow of the magnetic flux at the periphery of the central portion of the core in the coil may increase, and the magnetic flux neck may be mitigated. Optimizing the flow of the magnetic flux may improve the inductance characteristics and DC-bias characteristics of the inductor.

The degree by which plating growth is suppressed, and thus the difference in thicknesses between adjacent coil patterns, may be appropriately selected by those skilled in the art. The difference between the thicknesses preferably decreases toward the outer portion of the body, because an increase of the effective cross-sectional area for the flow of the magnetic flux at the periphery of the central portion of the core in the coil, in which the magnetic flux neck mainly occurs, is a major factor in optimizing the flow of the overall magnetic flux.

It is preferable that the line width "W1" of the upper surface of each coil pattern 131*a*, 131*b*, 131*c* is narrower than a line width "W2" of the lower surface of each respective coil pattern. It is preferable that the difference W2−W1 between the line width of the upper surface of the coil pattern and the line width of the lower surface of the coil pattern decreases toward the outer edge of the body, similar to the difference of the maximum thickness of the coil pattern. The line width W1 of the upper surface may be narrower than the line width W2 of the lower surface to adjust the maximum thickness of the coil pattern. One example of a method of forming the coil portion 13 is to laminate a photosensitive resin material having a thickness of about 200 μm on the support member, and to form an opening of a pattern corresponding to the coil pattern using light energy, and then fill the opening with the conductive material. The manner of filling the conductive material may be, for example, a plating growth method. While the widths of the lower portions of the respective openings may be made constant, the degree of plating growth may be controlled by differentiating an open area of the upper portions of the respective openings. This is because a difference in plating rate occurs as an inflow area of plating liquid varies in plating, and a difference in plating rate results in a difference in thickness of the coil pattern. Of course, as the open area of the upper portion of the opening becomes narrower, the plating liquid is less likely to flow, such that the plating rate becomes slower, and the thickness of the coil pattern becomes thinner. Thus, when the photosensitive resin material functioning as a guide for plating growth is removed after completion of the plating growth, in a case of a coil pattern in which the open area of the upper portion is relatively narrowed, the line width of the upper surface may be narrower than the line width of the lower surface.

When the line width of the upper surface is narrower than the line width of the lower surface, at least a portion of the inner side surface of the coil pattern may be configured with an inclined surface "S1." An inclination angle of the inclined surface of the inner side surface of the coil pattern, or a sectional area of the inclined surface may differ among the coil patterns. In the inner side surface of the coil pattern, a non-inclined portion may be configured to be substantially perpendicular to the support member. The flow of the magnetic flux generated from the coil portion may be relatively smooth due to the inclined surface.

The external surface of the coil pattern may be substantially perpendicular to the support member, such that at least a portion of the inner side surface of the coil pattern is different from the inclined surface. It is advantageous to construct a portion of the coil pattern to be perpendicular to the support member, rather than a boundary surface, to increase the cross-sectional area of the coil pattern. The external surface of the coil pattern may be substantially perpendicular to the upper surface of the coil pattern, which is substantially parallel to the support member, because the external surface of the coil pattern is substantially perpendicular to the support member.

The surface of the coil pattern is preferably insulated by an insulation layer 14. Since the insulation layer can prevent a short circuit between the coil pattern and the magnetic materials in the sealing portion. It is preferable to coat the insulation layer to a thickness of more than 1 μm to ensure insulation reliability. The insulation layer preferably includes a material with excellent insulating properties. An insulating material including a perylene resin may be coated by chemical vapor deposition to form a uniform and thin insulation layer.

As the inductor is miniaturized and has a low profile, the maximum thickness of the coil pattern may be differentiated to prevent the magnetic flux neck generated at the periphery of the core in the coil. The line width of the upper surface of the coil pattern may be narrower than the line width of the lower surface, and at least a portion of the inner side surface may be formed as an inclined surface, to differentiate the maximum thickness of the coil pattern. As a result, magnetic flux neck of the inductor may be alleviated to improve electrical characteristics such as inductance and DC bias. This may also provide sufficient space for packing magnetic materials from an upper margin region, that is, the upper surface of the body to the upper surface of the coil pattern, and also to improve reliability problem of breakage of the chip.

Second Embodiment

Figure 3:
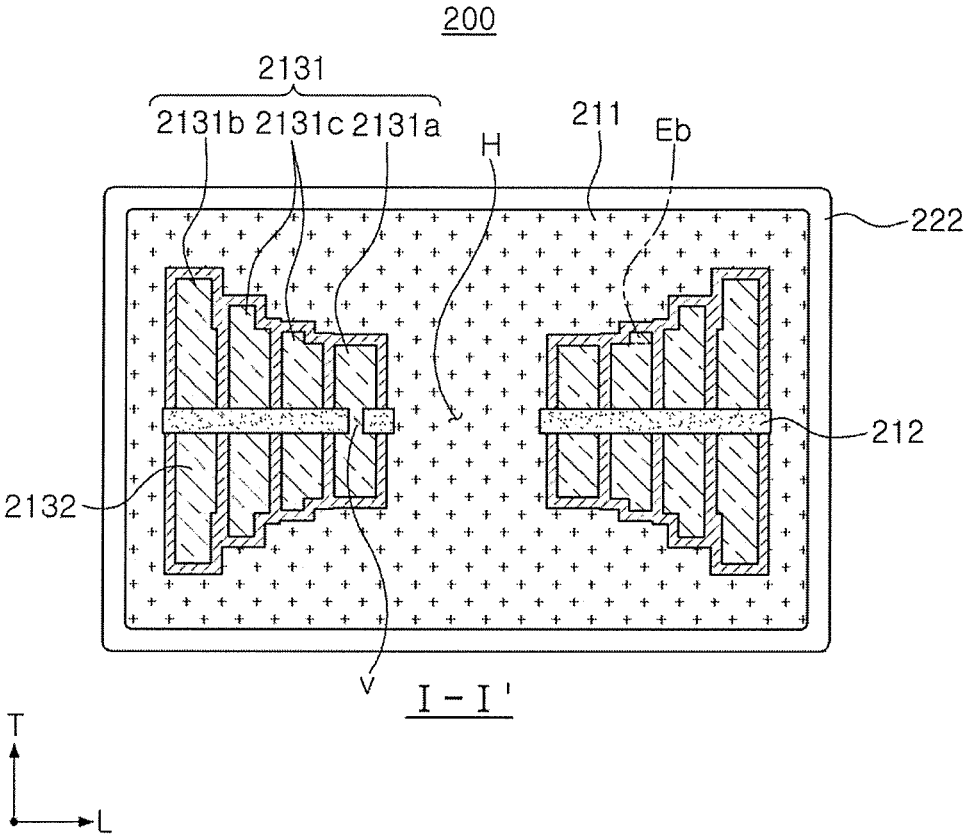
FIG. 3 is a cross-sectional view of an inductor according to a second embodiment of the present disclosure.

FIG. 3 is a cross-sectional view of an inductor 200 according to a second embodiment of the present disclosure. The inductor 200 may differ from the inductor 100 according to the first embodiment in terms of the specific cross-sectional shape of the coil pattern. The inductor 200 according to the second embodiment may include the same advantages and effects as those of the inductor 100 according to the first embodiment. As described above, the plating growth rate of the coil pattern may be differentiated by adjusting the shape of the opening of the photosensitive insulating resin functioning as a growth guide of the coil pattern, and, as a result, the maximum thickness of the coil pattern may be differentiated. For the sake of convenience, overlapping description of the technique will be omitted, and the cross-sectional shape of the coil pattern in the inductor will be mainly described.

Referring to FIG. 3, the inductor 200 may include a first coil 2131 and a second coil 2132 on upper and lower surfaces of a support member 212, respectively.

The first coil 2131 may include a plurality of coil patterns 2131*a*, 2131*b*, and 2131*c*, and an upper surface of at least one coil pattern in the plurality of coil patterns may include at least one protrusion portion.

Referring to a central coil pattern 2131*b* of the plurality of coil patterns, a protrusion portion "Eb" abutting the external surface of the coil pattern may be included. A cross-section of the protrusion portion may have a substantially rectangular shape, but the shape of the cross section of the protrusion portion may be appropriately selected by a person skilled in the art, and is not limited to a rectangular shape. When forming the coil pattern, a portion adjacent to the protrusion portion may be provided with a sealing portion of magnetic materials. When forming the coil pattern, the photosensitive insulating material may be disposed to prevent inflow of plating growth liquid in a position in which the sealing portion is disposed. The photosensitive insulating material may be removed, and the sealing portion may be filled in the removed position. As described above, it can be seen that the protrusion portion is a structure introduced to control the maximum thickness of the coil pattern.

The cross-sectional area of the protrusion portion may be appropriately selected by a person skilled in the art. The cross-sectional area of the protrusion portion of the outermost coil pattern may be wider as compared to that of inner coil patterns so that the thickness of the coil pattern adjacent to the outer portion of the body is relatively larger than that of the coil pattern at the periphery of the central portion of the core in the coil. When the cross-sectional area of the protrusion portion is widened such that the line width of the protrusion portion is equal to the line width of the lower surface of the coil pattern, the overall cross-sectional shape of the coil pattern may be rectangular.

The outer and inner side surfaces opposing each other in the coil pattern may be substantially parallel to each other. It should be understood that both the outer side surface and the inner side surface may be substantially parallel to each other and substantially perpendicular to the support member. Although not specifically illustrated, the outer side surface and the inner side surface of the coil pattern may be inclined in one direction. This is because when the opening portion of the photosensitive insulating material functioning as a growth guide of the coil pattern is patterned, or when plating liquid is introduced into the opening portion, a phenomenon of eccentricity in one direction may occur due to an error in a manufacturing process. Most of these cases do not cause significant deterioration in the electrical property values, except in extreme cases.

Figure 4:
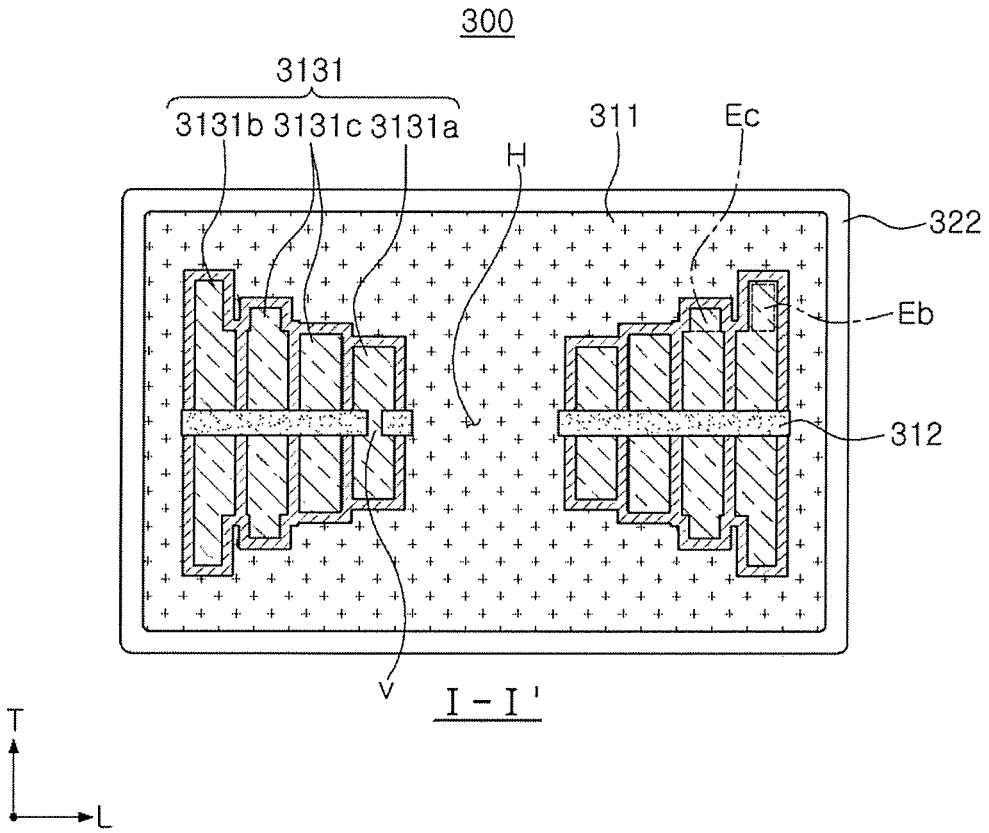
FIG. 4 is a cross-sectional view of an inductor according to a modified example of the inductor illustrated in FIG. 3.

FIG. 4 is a cross-sectional view of an inductor 300 according to a modified example of the inductor according to the second embodiment. For the sake of convenience, overlapping description of the inductor 200 explained with reference to FIG. 3 will be omitted.

Referring to FIG. 4, each of a plurality of coil patterns 3131*a*, 3131*b*, and 3131*c* may have different cross-sectional shapes. The upper surface of the innermost coil pattern 3131*a* may be substantially parallel to a support member and may lack a protrusion portion. In other words, the entire cross-sectional shape of the innermost coil pattern may be a substantially rectangular shape. The upper surface substantially parallel to the support member may not be flat due to a possible error in a process, and may be formed to be relatively convex or concave.

A central coil pattern 3131*c* may include a protrusion portion "Ec" at a central portion of the upper surface. That is, the outer side surface of the protrusion portion may be inward from the outer side surface of the remainder of the central coil pattern, and the inner side surface of the protrusion portion may be outward from the inner side surface of the remainder of the central coil pattern. The position of the protrusion portion Ec may be at an outer portion, such that the outer side surface of the protrusion portion is aligned with the outer side surface of the remainder of the central coil pattern. The line width of the protrusion portion of the central coil pattern may be narrower than the line width of the lower surface of the central coil pattern, such that the effect of preventing the inflow of the plating liquid may be included as it is. A protrusion portion "Eb" of the outermost coil pattern 3131*b* may be arranged at a position such that its outer side surface is aligned with the outer side surface of the remainder of the outermost coil pattern.

The different cross-sectional shapes of the plurality of coil patterns are not limited to the embodiment shown in FIG. 4. Preferably, the maximum thicknesses of the coil patterns increases toward the outer periphery of the body and the line widths of the lower surfaces of the coil patterns are wider than the line widths of the respective upper surfaces. Those skilled in the art may appropriately form and arrange the protrusion portions.

The present disclosure is not limited by the above-described embodiments and the accompanying drawings, but is intended to be limited by the appended claims. Accordingly, various modifications, substitutions, and alterations can be made by those skilled in the art without departing from the spirit of the present disclosure, which is also within the scope of the present disclosure.

The term "exemplary embodiment" used in this disclosure does not refer to the same embodiment, but is provided for emphasizing and explaining different characteristic features. The above-mentioned examples are not exclusive and may be implemented in combination with the features of other examples.

One of the effects of the present disclosure is to optimize flux flow through the entire area of the inductor and to improve the inductance and DC-bias characteristics.

While exemplary embodiments have been shown and described above, it will be apparent to those skilled in the art that modifications and variations could be made without departing from the scope of the present invention as defined by the appended claims.

What is claimed is:

1. An inductor comprising:

a body comprising:

a support member including a through-hole and a via hole, a coil portion including first and second coils on opposing surfaces of the support member, respectively, and a sealing portion including magnetic materials sealing the support member and the coil portion; and first and second external electrodes arranged on an external surface of the body, and connected to the first and second coils, respectively, wherein the coil portion includes a plurality of coil patterns, and a maximum thickness of each coil pattern of the plurality of coil patterns increases toward an outer portion of the body, each of the plurality of coil patterns includes a lower surface abutting the support member, and an upper surface opposing the lower surface and determining the maximum thickness of the coil pattern, and a line width of the lower surface is wider than a line width of the upper surface, and each of the plurality of coil patterns includes an inner side surface and an outer side surface that oppose each other and each extend between the lower surface and upper surface, and the inner side surface and the outer side surface of at least one coil pattern are asymmetrical to each other.

2. The inductor according to claim 1, wherein at least a portion of the upper surface is substantially parallel to the support member.

3. The inductor according to claim 1, wherein the coil portion has a spiral shape.

4. The inductor according to claim 1, wherein the body further comprises an insulation layer surrounding surfaces of the coil portion.

5. The inductor according to claim 1, wherein the through-hole is filled with the magnetic materials.

6. The inductor according to claim 1, wherein the via hole comprises conductive materials contained in the coil portion.

7. The inductor according to claim 1, wherein the outer side surface is substantially perpendicular to the support member.

8. The inductor according to claim 7, wherein an angle formed between the outer side surface and the upper surface is a right angle.

9. The inductor according to claim 7, wherein at least a portion of the inner side surface is an inclined surface.

10. The inductor according to claim 9, wherein surfaces other than the inclined surface in the inner side surface are substantially perpendicular to the support member.

11. The inductor according to claim 9, wherein respective thicknesses of the portions of the inner side surfaces of the plurality of coil patterns that are the inclined surfaces increase toward the innermost coil pattern of the plurality of coil patterns.

12. The inductor according to claim 1, wherein at least one of the plurality of coil patterns has at least one protrusion portion at an upper surface thereof.

13. The inductor according to claim 12, wherein a cross-sectional shape of the protrusion portion is a rectangular shape.

14. The inductor according to claim 12, wherein a line width of the protrusion portion is narrower than a line width of a lower surface of the coil pattern.

15. The inductor according to claim 12, wherein an inner side surface and an outer side surface of the coil pattern having the protrusion portion are substantially perpendicular to the support member.

16. The inductor according to claim 12, wherein an inner side surface and an outer side surface of the coil pattern having the protrusion portion are substantially parallel to each other.

17. An inductor, comprising:

a support member, including a through-hole;

a plurality of coil patterns on a surface of the support member and surrounding the through-hole;

a sealing portion including magnetic materials and substantially enclosing the support member and the plurality of coil patterns; and an external electrode electrically coupled to the plurality of coil patterns, wherein the plurality of coil patterns includes an outer coil pattern and an inner coil pattern between the outer coil pattern and the through-hole, the inner coil pattern has a first maximum thickness and an upper surface of the inner coil pattern has a first upper line width, the outer coil pattern has a second maximum thickness and an upper surface of the outer coil pattern has a second upper line width, the first maximum thickness is smaller than the second maximum thickness, and the first upper line width is smaller than the second upper line width.

18. The inductor according to claim 17, wherein:

a lower surface of the inner coil pattern has a first lower line width, a lower surface of the outer coil pattern has a second lower line width, the first and second lower line widths are substantially equal to each other, and the first lower line width is larger than the first upper line width, and the inner coil pattern includes an inclined portion from the first lower line width to the first upper line width.

19. The inductor according to claim 17, wherein:

the inner coil pattern has an outer surface opposing the through-hole and an inner surface facing the through-hole, the outer surface of the inner coil pattern is substantially perpendicular to the surface of the support member, and the inner surface of the inner coil pattern includes an inclined portion where the inner surface inclines toward the outer surface away from the support member.

20. The inductor according to claim 17, wherein:

the plurality of coil patterns further includes an intermediate coil pattern between the inner coil pattern and the outer coil pattern, the intermediate coil pattern has a third maximum thickness and an upper surface of the intermediate coil pattern has a third upper line width, the third maximum thickness is between the first maximum thickness and the second maximum thickness, and the third upper line width is between the first upper line width and the second upper line width.

21. An inductor, comprising:

a support member, including a through-hole;

a plurality of coil patterns on a surface of the support member and surrounding the through-hole;

a sealing portion including magnetic materials and substantially enclosing the support member and the plurality of coil patterns; and an external electrode electrically coupled to the plurality of coil patterns, wherein the plurality of coil patterns includes an outer coil pattern and an inner coil pattern between the outer coil pattern and the through-hole, a protrusion is disposed on only the outer coil pattern from among the inner and outer coil patterns, the outer coil pattern includes a main portion with a first line width, and the protrusion portion above the main portion and with a second line width smaller than the first line width, and a first thickness of the inner coil pattern is smaller than a second thickness of the main and protrusion portions of the outer coil pattern.

22. The inductor according to claim 21, wherein the protrusion portion of the outer coil pattern has an outer side surface opposing the through-hole and aligned with an outer side surface of the main portion of the outer coil pattern, and an inner side surface facing the through-hole and further away from the through-hole than an inner side surface of the main portion of the outer coil pattern.

23. The inductor according to claim 21, wherein:

the plurality of coil patterns further includes an intermediate coil pattern between the inner coil pattern and the outer coil pattern, the intermediate coil pattern includes a main portion with the first line width, and a protrusion portion above the main portion and with a third line width smaller than the first line width, and a third thickness of the main and protrusion portions of the intermediate coil pattern is larger than the first thickness of the inner coil pattern and is smaller than the second thickness of the main and protrusion portions of the outer coil pattern.

24. The inductor according to claim 23, wherein:

the protrusion portion of the outer coil pattern has an outer side surface opposing the through-hole and aligned with an outer side surface of the main portion of the outer coil pattern, and an inner side surface facing the through-hole and further away from the through-hole than an inner side surface of the main portion of the outer coil pattern, and the protrusion portion of the intermediate coil pattern has an outer side surface opposing the through-hole and aligned with an outer side surface of the main portion of the intermediate coil pattern, and an inner side surface facing the through-hole and further away from the through-hole than an inner side surface of the main portion of the intermediate coil pattern.

* * * * *